US005630516A

United States Patent [19]

Helman

[11] Patent Number: 5,630,516

[45] Date of Patent: May 20, 1997

[54] BALL CAP DISPLAY AND STORAGE RACK ASSEMBLY

[75] Inventor: Barry Helman, Oxnard, Calif.

[73] Assignee: Hersh/Helman, Inc., Oxnard, Calif.

[21] Appl. No.: 549,269

[22] Filed: Oct. 27, 1995

[51] Int. Cl.[6] ..... A47F 7/00

[52] U.S. Cl. ..... 211/32

[58] Field of Search ..... 211/32, 30, 31, 211/33, 106, 89, 124; D6/411, 412, 415, 553

[56] References Cited

U.S. PATENT DOCUMENTS

| | | | |
|---|---|---|---|
| D. 326,366 | 5/1992 | Fung | 211/32 |
| 5,188,325 | 2/1993 | Hilty et al. | 211/32 X |
| 5,240,123 | 8/1993 | Hawk | 211/32 |
| 5,295,588 | 3/1994 | Neirinckx | 211/32 |

*Primary Examiner*—Alvin C. Chin-Shue
*Assistant Examiner*—Sarah L. Purol
*Attorney, Agent, or Firm*—Marvin E. Jacobs

[57] ABSTRACT

Ball cap display and storage rack assembly comprising vertical members with lateral cross members formed to cooperate with ball cap capture arms rotatably snapped onto the cross members. The cap capture arm can accept the crown button of a ball cap whose rearward head cover portion has been collapsed forward towards the cap visor into the front head cover portion. The cap capture arm can then be rotated downward to capture the cap, via its crown button, between the capture arm and the cross member. A plurality of caps may be stored limited only by the area covered by the rack assembly. By suitably shaping and positioning the cross members during fabrication, a uniform and attractive display of the stored ball caps is achieved. The design of the cross members and the capture arm is such that the ball caps are presented much as they appear when worn thus logos and lettering on the visor and head cover portions are easily visualized. The arrangement of the ball caps in the rack assembly also provides for the addition or removal of a ball cap from the rack without removing or disturbing previously stored and displayed caps.

13 Claims, 1 Drawing Sheet

BALL CAP DISPLAY AND STORAGE RACK ASSEMBLY

TECHNICAL FIELD

The present invention relates to a device which is used to display and store a plurality of hats and caps, more particularly ball caps, such that advertising copy, logos, lettering and the like, which are typically affixed to the head cover and visor portions of ball caps, may be seen.

BACKGROUND OF THE INVENTION

There have been a number of devices and methods used to store hats individually and in groups. Common practice involves using a variety of hooks for hat and cap storage. Davis (U.S. Pat. No. 4,993,557) stores a number of caps in a stacked arrangement. Similarly Lema (U.S. Pat. No. 5,348,166) stacks nested caps. Both devices have limited utility since the advertising and logos of the stored caps are not visible. Furthermore, both of these do not permit storage and retrieval of individual caps without disturbing previously stored caps. These prior art devices "nest" the hats such that previously stored hats must be either moved or removed to add a hat, or lifted or raised to remove all but the most recent addition to the stored hats. A further problem with these devices is that the advertising, logos and lettering on the front face of the cap is not displayed.

Another cap storage device on the market consists of a plurality of horizontal rods over which an "alligator" type clip is slidably placed, the clip being used to grasp some portion of the cap or hat. Although this prior art provides for minimizing the disturbance of prior stored caps during the addition or removal of a cap, the caps are not readily or automatically presented in an orderly or attractive arrangement. An additional problem with this device is that when this cap storage apparatus is moved, the clips from which the caps are suspended, are free to slide along the horizontal rods thus disturbing any prior symmetry or order in the cap storage arrangement.

STATEMENT OF THE INVENTION

This invention provides a novel rack assembly for an attractive, compact and convenient device for the display and storage of a large number of ball caps and the like. This device further permits the addition of an individual cap to the display, or removal of a previously stored cap, without disturbing or moving other caps in the display.

An additional feature of the rack assembly of the invention is a spatially uniform and orderly display of the stored caps. This assembly furthermore presents the ball caps to the observer in an orientation identical to that seen when the cap is worn. This presentation clearly and distinctly displays the advertising/logos on both the head cover and visor portions so that they are readily seen. This presentation also allows for the ready identification of the fabrics from which the cap is constructed.

The cap display and storage assembly of the invention that can conveniently be suspended from a horizontal closet rod, a door, or can be attached to a vertical surface.

Briefly, a presently preferred embodiment of this invention is comprised of a rack assembly with vertical members connected by cross members which incorporate uniformly distributed, fixed and outwardly projecting cap support segments and an equal number of cooperating cap capture arms. A cap capture arm, is comprised of a planar portion, a guide bar and a hinge. The planar portion can have an opening to admit and retain the crown button of a ball cap. The hinge permits a capture arm to rotate down to the support segment and thus secure a ball cap to the rack. Alignment of the cap capture arm with its cooperating cap support segment can be provided by the guide bar entering an aperture in the cooperating cap support segment. The rack assembly can have eyelets or hooks by which it may be attached to a vertical surface, a door, or the like.

The rack assembly described by this invention may be constructed from light weight materials, using simple and inexpensive fabrication methods. The result is a low cost, easy to install, practical and useful device.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
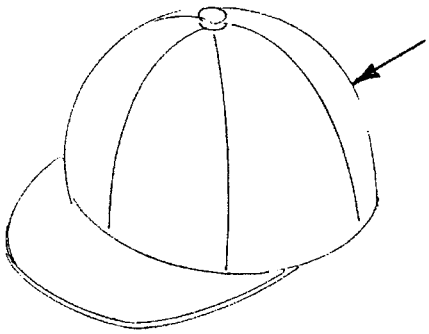
FIG. 1 is a perspective view of the rack assembly showing ball caps in the collapsed condition stored on the rack assembly according to one configuration for this invention.

Referring now to FIG. 1, a version of this invention is shown as might be fabricated from rod or wire material wherein the rack assembly is formed from vertical members 1 and cross members 4 in a generally rectangular configuration although other configurations are readily identifiable and suitable for the purposes of this invention. The cross members may have any number of fixed cap support segments 2, or none 5. The cross members 5 with no cap support segments primarily provide structural support to the rack and to a convenient rack hanging means such as a washer 3.

The vertical members 1 and the cross members 4,5 may be of any suitable length sufficient to accommodate the desired number of caps. The longer the vertical members 1, the greater the number of cross members 4 that can be accommodated The wider the cross members 4, the greater the number of fixed cap support segments 2 that may be included. The total number of caps 12 accommodated being equal to the number of cross members 4 having support segments 2 multiplied by the number of cap support segments 2 on each cross member. Each fixed, outwardly projecting cap support segment 2, in cooperation with a cap capture arm 7, retains one cap.

Figure 2:
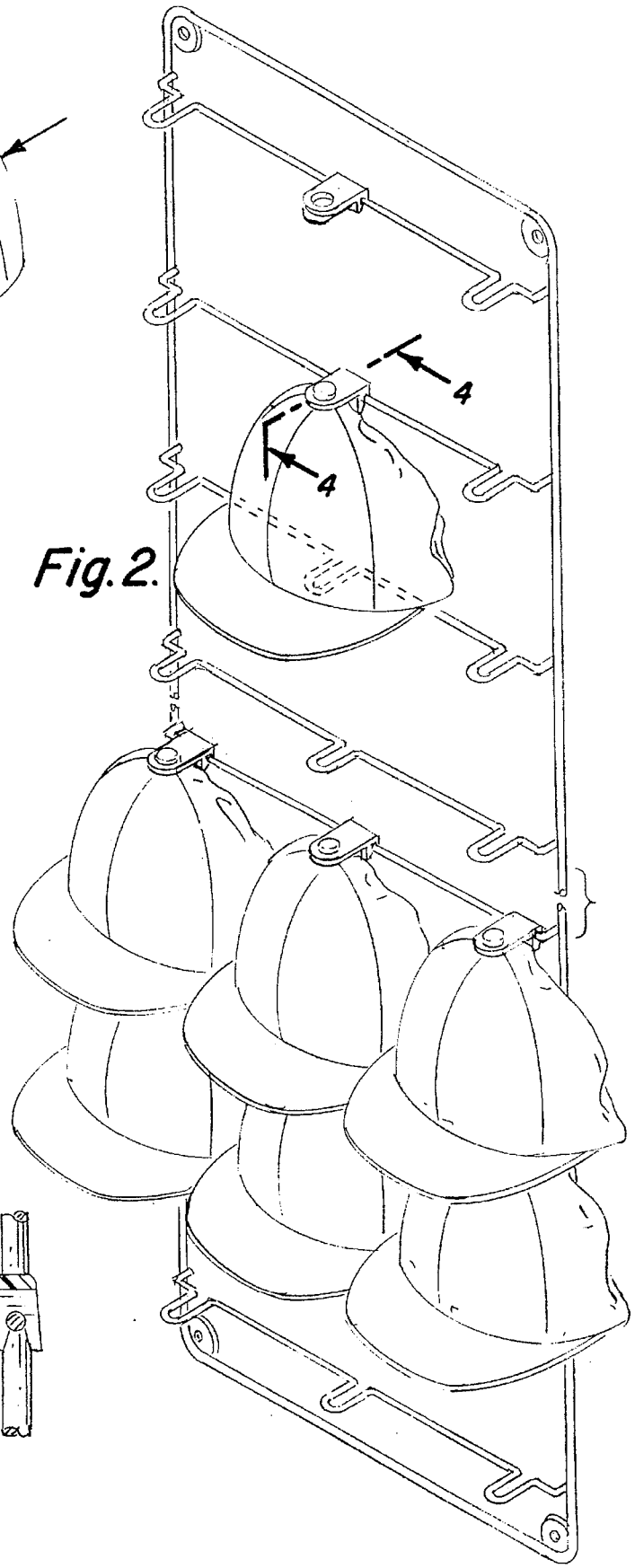
FIG. 2 is a perspective view of a ball cap capture arm.

Referring now to FIG. 2, the cap capture arm 7 comprises a planar portion 11, a guide bar 9 and hinge tabs 8. In the configuration shown, there is a pair of hinge tabs 8 at the rearward end of the planar portion 11 which snap around the cross member 4 on both sides of an outwardly projecting cap support segment 2. By snapping onto the cross member, the tabs 8 are free to rotate around the axis of the cross member but because of friction between the tabs 8 and the cross member 4, the tabs remain in their angular position until moved by hand such as required when attaching or removing a ball cap 12. The hinge tabs 8 are separated from each other such that the guide bar 9 is centrally located with respect to an aperture 6 in the corresponding cap support segment 2 of cross member 4. Within the planar portion 11 of the capture arm, an opening 10 is provided between the front and rearward ends to accept a crown button 17 of a collapsed ball cap 12.

Figure 3:
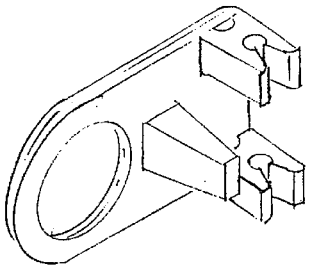
FIG. 3 is a perspective view of a ball cap in its normal configuration showing its crown button.
Figure 4:
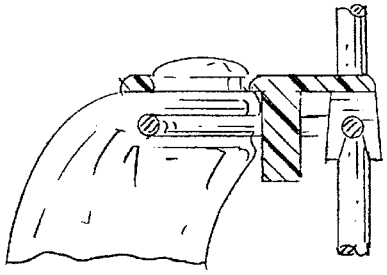
FIG. 4 is a detailed section view of a ball cap held by the ball cap capture arm.

Referring now to FIG. 3, the cap 12 is readied for storage and display by collapsing or folding the rearward portion 13 of the cap head cover 16, towards the visor 15, into the forward cap head cover portion 14, thus fully presenting the crown button 17. The fully presented crown button is then inserted into the opening 10 of the planar portion 11. The planar portion is then moved downwardly causing the hinge tabs 8 to rotate about the axis of the cross member towards the cap support segment 2. Simultaneously with the rotating action, the guide bar 9, preferably tapered towards its distal end, enters and frictionally engages the cap support segment 2 through the aperture 6. Thus the ball cap 12 is firmly secured, via the crown button, between the capture arm 7 and the cap support segment 2 on the cross member 4.

To remove a cap, the planar portion 11 of the capture arm 7 is readily moved upward, by hand, rotating the hinge tabs 8 about the cross member 4 axis and thus withdrawing the guide bar 9 from the aperture 6 of the cap support segment 2. The cap crown button 17 is then easily removed from the opening 10 and the ball cap 12 is thus released.

In the previously described embodiment, the rack is formed rod or wire stock. The rod stock may be formed from any suitable material, but typically an inexpensive metal such as aluminum, that can be formed into the described configuration. The rod stock may be suitably coated and protected by any appropriate coating, including paint, vinyl or anodization.

A rack assembly as described may also be similarly fabricated out of metal wire stock, typically an iron alloy. Other fabrication materials for the rack assembly are readily visualized. Molded synthetic resins are suitable for all the components. Wood may be used for the vertical members and the cross members. The cap capture arm is most practically formed from a synthetic resin material but may also be formed from a cast or machined metal.

Configurations other that the embodiment described are also readily identified. The exterior form of the rack assembly may take any geometric shape other than rectangular. Particularly attractive configurations include triangles, circles, ovals, and others. The cross sections of the vertical and cross members may be other than circular as would be the case with rod or wire material. Racks with such cross sections could be fabricated from sheets of plastic, wood or metal.

It is to be realized that only preferred embodiments of this invention have been described, and that numerous substitutions, modifications, alterations, and applications are permissible without departing from the spirit and scope of the invention as defined in the following claims.

I claim:

1. A rack assembly for displaying and storing caps, and the like, having a head cover portion comprising:

a rack having;

at least two vertical members;

at least two cross members extending laterally between and connected to said vertical members, at least one of said cross members having at least one fixed and outwardly projecting cap support segment; and a plurality of capture arms for capturing the head cover portion, removably and hingeably attached to said cross members and each cooperating with one of said fixed cap support segments to capture, position, retain and release the head cover portion of said caps and the like.

2. A rack assembly according to claim 1 in which the caps are baseball caps and a plurality of fixed, outwardly projecting cap support segments are uniformly spaced on the cross members between the vertical members by the approximate width of standard baseball caps.

3. A rack assembly according to claim 2 in which the cross members are vertically spaced by the approximate height of the head cover portion of standard baseball caps.

4. A rack assembly according to claim 1 in which the rack has at least one eyelet whereby the rack assembly may be secured to, and supported by, a vertical surface.

5. A rack assembly according to claim 1 having at least one removable hook whereby the rack assembly may be suspended from a closet clothes rod or the top of a door.

6. A rack assembly according to claim 1 in which the cap is a baseball cap having a crown button and the capture arms comprise:

a planar portion having front and rearward ends and having an opening adjacent to the front end sized to admit the crown button of a baseball cap;

at least one hinge tab which depends from the rearward end of said planar portion, having a slot formed to frictionally accommodate and snap onto cross members; and a guide bar depending from the planar portion and located rearward of said opening so as to position the ball cap crown button under said opening and align said cap capture arm with the cooperating outwardly projecting cap support segment.

7. A rack assembly according to claim 6 in which the fixed and outwardly projecting cap support segments have an aperture to receive and frictionally engage said guide bar as the cap capture arm is pivoted downward about the axis of the hinge tabs thereby securing the ball cap via its crown button to the rack assembly.

8. A rack assembly according to claim 1 in which the fixed and outwardly projecting cap support segments are integral with said cross members.

9. A rack assembly according to claim 6 in which the guide bars each have a cross section tapering continuously to its distal end from its point of attachment to said planar portion.

10. A rack assembly according to claim 9 in which the guide bars taper is over a smaller portion proximate to the distal end of the guide bar.

11. A rack assembly according to claim 1 in which said vertical members and cross members are fabricated from a rigid material such as metal, wood or synthetic resin.

12. A rack assembly according to claim 1 in which said vertical members and said cross members have cross sections which are cylindrical, rectangular or square.

13. A rack assembly according to claim 1 in which a cap capture arm is fabricated from a synthetic resin.

* * * * *